United States Patent [19]

Tanner, Jr. et al.

[11] 4,184,901

[45] Jan. 22, 1980

[54] SIMULTANEOUS YELLOW SMOKE AND YELLOW FLAME COMPOSITION CONTAINING BISMUTH SUBNITRATE

[75] Inventors: John E. Tanner, Jr., Bloomington; Henry A. Webster, III, Ellettsville, both of Ind.

[73] Assignee: The United States of America as represented by the Secretary of the Navy, Washington, D.C.

[21] Appl. No.: 935,423

[22] Filed: Aug. 21, 1978

[51] Int. Cl.[2] ..... C06B 45/10

[52] U.S. Cl. ..... 149/19.6; 149/20; 149/44; 149/45; 149/116; 149/117

[58] Field of Search ..... 149/19.6, 20, 116, 117, 149/61, 45, 44

[56] References Cited

U.S. PATENT DOCUMENTS

| | | | |
|---|---|---|---|
| 2,968,542 | 1/1961 | Brock | 149/19.6 |
| 2,995,526 | 8/1961 | DeMent | 149/22 |
| 3,046,168 | 7/1962 | Burkardt et al. | 149/42 |
| 3,411,963 | 11/1968 | Douda | 149/19.6 |
| 3,488,237 | 1/1970 | Hiltz | 149/45 |
| 3,497,404 | 2/1970 | Hiltz | 149/45 |
| 3,733,223 | 5/1973 | Lohkamp | 149/19.6 |
| 3,769,107 | 10/1973 | Johnson et al. | 149/19.6 |
| 3,908,550 | 9/1975 | Beatty et al. | 102/37.4 |
| 3,960,087 | 6/1976 | Beatty et al. | 102/90 |
| 4,032,374 | 6/1977 | Douda et al. | 149/19.8 |

OTHER PUBLICATIONS

Grant, "Hackh's Chemical Dictionary", 4th Ed., p. 100, McGraw-Hill Book Company (1969) New York.

*Primary Examiner*—Edward A. Miller
*Attorney, Agent, or Firm*—R. S. Sciascia; Paul S. Collignon

[57] ABSTRACT

A pyrotechnic composition which, when burned, produces yellow smoke and yellow flame. The composition is comprised of between 5 and 30 percent of a fuel which is either magnesium or silicon, between 65 and 85 percent of bismuth subnitrate and between 5 and 13 percent of an epoxy binder.

8 Claims, No Drawings

SIMULTANEOUS YELLOW SMOKE AND YELLOW FLAME COMPOSITION CONTAINING BISMUTH SUBNITRATE

BACKGROUND OF THE INVENTION

The present invention relates to a composition which, when burned, will produce both yellow smoke and yellow flame.

The basic use of colored displays is for communication and colored signals are used to indicate conditions of distress, identification, recognition and warming. Color signals are also used as markers to indicate the position of opposing elements for purposes of acquisition and attack. The basic requirement for a colored display is that it must provide a highly visible, unambiguous, easily identifiable mark.

Colored displays generally take the form of colored flares for night signaling and colored smokes for day signaling. Many devices provide only the single signal, that is, it will produce either smoke or flame, but not both, thus it is frequently necessary to carry both smoke signals or flare signals.

In order to eliminate the necessity of carrying two types of signals, some signals are made that serve a dual function. In one type of signal, a smoke signal is provided on one end and a flare signal is provided on the opposite end. One such device is shown in U.S. Pat. No. 3,908,550, entitled One Hand Operable Distress Signal, which issued Sept. 30, 1975, to Bobby D. Beatty et al. In this distress signal a container is provided which has a smoke-producing composition in one end and a flare composition in the other end. Each pyrotechnic composition is contained in a separate inner container which in turn are housed in a telescoping fashion in each end of an outer container. A spring is provided for extending each inner container and a locking lever is provided for retaining the inner container inside the outer container. Once the inner container is extended, a manual firing lever is accessible for actuating a firing pin which detonates a primer and, in turn, ignites a pyrotechnic material.

One disadvantage to devices which provide both a smoke signal and a flare signal is that the time of display for each signal is relatively short in order to provide for both displays and normally the unit is lost or discarded after burning one end. Also these devices are relatively expensive as dual hardware is used on both ends.

In order to eliminate dual hardware, some dual units are made which are designed to burn first a smoke composition followed by a flare. Obviously, of course, the shorter display time is still present. An additional disadvantage with this signal is one of producing a good flare color. In operation, these signals first burn the smoke composition and a solid carbonaceous clinker remains after the burning reaction. When the flare composition is ignited, the flame must burn through the center of this clinker and the color of the flame can be severely degraded.

SUMMARY OF THE INVENTION

The present invention relates to a pyrotechnic composition which, when burned, will produce both yellow smoke and yellow flame. The composition is comprised of between 5 and 30 percent of a fuel, which is either magnesium or silicon, between 65 and 85 percent of bismuth subnitrate and between 5 and 13 percent of an epoxy binder.

It is therefore a general object of the present invention to provide a pyrotechnic composition which, upon burning, will produce both yellow smoke and a yellow flame.

Other objects and advantages of the present invention will be readily appreciated as the same becomes better understood by reference to the following detailed description.

DESCRIPTION OF THE PREFERRED EMBODIMENTS

The yellow smoke/yellow flame compositions of the present invention are comprised essentially of between 5 and 30 percent of a fuel, which is either magnesium or silicon, between 65 and 85 percent of bismuth subnitrate and between 5 and 13 percent of an epoxy binder. By way of example, the epoxy binder might be obtained from Dow Chemical Co. and consists of a mixture of 70 percent DER 321 and 30 percent DEH.

In making of the pyrotechnic candles, hydrated bismuth nitrate was initially used as an oxidizer with magnesium as the fuel. These flares ignited spontaneously within minutes after pressing, as a magnesium-water or magnesium-nitric acid reaction occurred which generated sufficient heat to ignite the epoxy binder and, subsequently, the remaining magnesium. Consequently, all the compositions of the present invention use bismuth subnitrate. Sensitivity tests, that is, friction, impact and electrostatic tests, were performed on all the formulas, without added binder, and all were found to be relatively insensitive. Tests were also made by adding a small amount of water to each formula and no reactions were observed. There were no problems encountered in the subsequent mixing and pressing operations.

The following examples will illustrate the preferred embodiments of the invention wherein parts and percentages are by weight unless otherwise specified.

| EXAMPLE I | PERCENT |
|---|---|
| Magnesium (Gram 16) | 14 |
| Bismuth Subnitrate | 68 |
| Diatomaceous earth | 5 |
| Epoxy binder | 13 |

The ingredients were mixed and 150 grams of composition were pressed at a pressure of 8300 psi into a 4.35 cm diameter fishpaper tube. The overall candle length was 3.8 cm. Approximately 20 grams of fireclay was pressed on one end of the candle and 10 grams of ignition composition was pressed on the other end.

The candle was burned face-up in a static environment. A standard yellow organic dye smoke composition was burned for a color comparison. The candle was burned with the following results:

| | |
|---|---|
| Burn rate (cm/s) | 0.11 |
| Smoke color | Yellow/white |
| Smoke volume | Excellent |
| Flame Color | Yellow (very vigorous) |

| EXAMPLE 2 | |
|---|---|
| Magnesium (Gram 18) | 10 |
| Bismuth subnitrate | 85 |

-continued

| | |
|---|---|
| Epoxy binder | 5 |

The ingredients were mixed and a candle was made as described in EXAMPLE 1. The candle was burned with the following results:

| | PERCENT |
|---|---|
| Burn rate (cm/s) | 0.069 |
| Smoke color | Light Yellow |
| Smoke volume | Good |
| Flame color | Yellow |

EXAMPLE 3

| | |
|---|---|
| Magnesium (Gram 18) | 10 |
| Bismuth subnitrate | 80 |
| Epoxy binder | 5 |
| Diatomaceous earth | 5 |

The ingredients were mixed and a candle was made as described in EXAMPLE 1. The candle was burned with the following results:

| | |
|---|---|
| Burn rate (cm/s) | 0.073 |
| Smoke color | Light Yellow |
| Smoke volume | Excellent |
| Flame color | Yellow |

EXAMPLE 4

| | |
|---|---|
| Silicon | 10 |
| Bismuth subnitrate | 85 |
| Epoxy binder | 5 |

The ingredients were mixed and a candle was made as described in EXAMPLE 1. The candle was burned with the following results:

| | PERCENT |
|---|---|
| Burn rate (cm/s) | 0.079 |
| Smoke color | Light Yellow |
| Smoke volume | Fair |
| Flame color | Weak Yellow |

EXAMPLE 5

| | |
|---|---|
| Silicon | 10 |
| Bismuth subnitrate | 80 |
| Epoxy binder | 5 |
| Sodium nitrate | 5 |

The ingredients were mixed and a candle was made as described in EXAMPLE 1. The candle was burned with the following results:

| | |
|---|---|
| Burn rate (cm/s) | 0.069 |
| Smoke color | Almost white |
| Smoke volume | Fair |
| Flame color | Yellow |

The candles were tested outdoors under a variety of meteorological conditions. In most cases, testing was done on days when the relative humidity was high, that is, greater than 85 percent. This was done purposely to insure that the smokes produced would not lose their color due to hydrolysis of the smoke particles.

Silicon was used as a fuel in EXAMPLES 4 and 5 above, and the burning was much less vigorous than those candles having magnesium. While the burning rates of the silicon-containing candles are comparable to those of the candles containing magnesium, the smoke and flame output are much less and the flame is yellow but not intense. Luminous output of the silicon-containing candles was estimated to be less than 1000 cp. The best smoke in the silicon series was produced by the formula listed in EXAMPLE 4. The yellow color was acceptable but the volume of smoke was not good.

Magnesium was used as a fuel in EXAMPLES 1 to 3 above and the formulas listed in EXAMPLES 2 and 3 both produced good yellow smokes and yellow flames. The burning rates were approximately 0.07 cm/s and the volume of smoke appears to be a little larger in EXAMPLE 3 and the smoke cloud tended to remain together a little longer. The best smoke/flame combination in the magnesium series was produced by the formula of EXAMPLE 3.

It can thus be seen that the present invention provides improved compositions for producing both yellow smoke and yellow flame. Upon burning, the candles of the present invention have an advantage of being less toxic than lead compounds and are also less sensitive to humidity.

Obviously many modifications and variations of the present invention are possible in the light of the above teachings. It is therefore to be understood that the invention may be practiced otherwise than as specifically described.

We claim:

1. A pyrotechnic composition for simultaneously producing yellow smoke and yellow flame comprised, by weight, of between 5 and 30 percent of a fuel selected from a group consisting of magnesium and silicon, between 65 and 85 percent of bismuth subnitrate, and between 5 and 13 percent of an epoxy binder.

2. A pyrotechnic composition for simultaneously producing yellow smoke and yellow flame as set forth in claim 1 having about 5 percent of diatomaceous earth.

3. A pyrotechnic composition for simultaneously producing yellow smoke and yellow flame as set forth in claim 1 wherein said fuel is magnesium.

4. A pyrotechnic composition for simultaneously producing yellow smoke and yellow flame as set forth in claim 1 wherein said fuel is silicon.

5. A pyrotechnic composition for simultaneously producing yellow smoke and yellow flame as set forth in claim 1 having about 10 percent of magnesium and about 85 percent of bismuth subnitrate.

6. A pyrotechnic composition for simultaneously producing yellow smoke and yellow flame as set forth in claim 1 having about 10 percent of silicon and about 85 percent of bismuth subnitrate.

7. A pyrotechnic composition which, upon burning, produces yellow smoke and yellow flame comprised, by weight, of about 10 percent of magnesium, about 80 percent of bismuth subnitrate, about 5 percent of diatomaceous earth and about 5 percent of epoxy binder.

8. A pyrotechnic composition which, upon burning, produces yellow smoke and yellow flame as set forth in claim 7 wherein said epoxy binder is comprised of about 70 percent of resin and about 30 percent of hardener.

* * * * *